US006596358B1

(12) United States Patent
Sakamoto et al.

(10) Patent No.: US 6,596,358 B1
(45) Date of Patent: Jul. 22, 2003

(54) THERMALLY SENSITIVE RECORDING TYPE ADHESIVE LEVEL

(75) Inventors: Tastuhiko Sakamoto, Chiyoda-ku (JP); Yoshihide Kimura, Shinjuku-ku (JP); Naomi Sumikawa, Shinjuku-ku (JP); Hidenori Ogawa, Shinjuku-ku (JP)

(73) Assignee: Nippon Paper Industries Co Ltd, Tokyo (JP)

( * ) Notice: Subject to any disclaimer, the term of this patent is extended or adjusted under 35 U.S.C. 154(b) by 112 days.

(21) Appl. No.: 09/643,677

(22) Filed: Aug. 24, 2000

(30) Foreign Application Priority Data

Aug. 27, 1999 (JP) ..... 11-240800

(51) Int. Cl.[7] ..... G09F 3/02

(52) U.S. Cl. ..... 428/40.1; 428/41.6; 428/41.7; 428/41.8; 428/537.5; 428/913; 503/226

(58) Field of Search ..... 428/40.1, 41.6, 428/41.7, 41.8, 913, 537.5; 503/226

(56) References Cited

U.S. PATENT DOCUMENTS

| | | | | |
|---|---|---|---|---|
| 4,837,196 A | | 6/1989 | Ogata | |
| 5,998,082 A | * | 12/1999 | Jimbo | 430/138 |

FOREIGN PATENT DOCUMENTS

| | | |
|---|---|---|
| DE | 3806201 | 9/1988 |
| EP | 0373903 | 12/1989 |
| GB | 2184557 | 6/1987 |
| JP | 2116593 | 5/1990 |
| JP | 768932 | 3/1995 |
| JP | 9183270 | 7/1997 |

OTHER PUBLICATIONS

Patent Abstract of Japan, JP 02116593, published JPO May 1, 1990.

Patent Abstract of Japan, JP 0706892, published JPO Mar. 14, 1995.

Patent Abstract of Japan, JP 09183270, published JPO Jul. 15, 1997.

* cited by examiner

*Primary Examiner*—Nasser Ahmad
(74) *Attorney, Agent, or Firm*—Sherman & Shalloway

(57) ABSTRACT

The present invention is to provide a thermally sensitive recording type adhesive label possessing a thermally sensitive recording layer on a substrate, and an adhesive layer and a release paper on the reverse side of the substrate, wherein said substrate is a neutral paper containing a wet strength reinforcing agent and further containing 5–20 wt. % of a filler to the total weight of pulp.

8 Claims, No Drawings

THERMALLY SENSITIVE RECORDING TYPE ADHESIVE LEVEL

BACKGROUND OF THE INVENTION

1. Field of the Invention

The present invention relates to a thermally sensitive recording type adhesive label to the reverse side of which an adhesive layer and a release paper are arranged.

2. Description of the Prior Art

In general, a thermally sensitive recording paper prepared by forming a thermally sensitive recording layer mainly containing a colorless or pale colored basic colorless dye and a color developer that makes said basic colorless dye develop color by heat on a sheet type substrate is well known. And a thermally sensitive recording type adhesive label to the reverse side of which an adhesive layer and a release paper are prepared is proposed to be used for a thermally sensitive recording type label for wrapping or a POS label for foods used at super markets. In a case of above mentioned thermally sensitive recording type adhesive label, compared with the conventional printing methods that use ink or an ink ribbon, since the printing is carried out by a thermal head, this type has an advantage that printing is more easily and that the printed image is more beautiful.

However, this kind of thermally sensitive recording type adhesive label has a problem that when is wetted by water or when is placed in a high humid condition, said thermally sensitive recording type adhesive label swells by absorbed water and the adhesive layer is easily scaled off from the substrate, because, generally a substrate and the surface of an adhesive layer are hydrophilic. As the substrate which has good water resistance, a base paper for diazo photo sensitive paper has high sized and lower pH is well known, however, said paper becomes transparent when water is stuck and the readout of a barcode becomes difficult. Therefore, to avoid said problem, it is necessary to take a countermeasure, for example, that titanium di-oxide is added in an adhesive layer.

Meanwhile, in the field of the thermally sensitive recording paper, it is well known to use a neutral paper as a substrate. However, if a neutral paper is used as the substrate of the thermally sensitive recording type adhesive label, the tendency that it deteriorates the adhesive strength of an adhesive layer is usually obserbed.

BRIEF SUMMARY OF THE INVENTION

The object of the present invention is to provide a thermally sensitive recording type adhesive label which has high printing density and has good brightness and preservability of background color, further does not cause the scaling off of an adhesive layer when is wetted by water or when is exposed in high humid condition.

The inventor of this invention has carried out an intensive study to dissolve the above-mentioned problem, and accomplished the thermally sensitive recording type adhesive label of this invention. That is, the present invention is a thermally sensitive recording type adhesive label possessing a thermally sensitive recording layer on a substrate, and an adhesive layer and a release paper on the reverse side of the substrate, wherein said substrate is a neutral paper containing a wet strength reinforcing agent and further containing 5–20 wt. % of a filler to the total weight of pulp.

The present invention is accomplished by finding out that the above-mentioned construction of a thermally sensitive recording type adhesive label can dissolve the problems. A diazo base paper has a good water resistance, however, when it is used as a substrate, the background color and the background color preservability of thermally sensitive recording type adhesive label are easily deteriorated. Since the property of the diazo base paper is acidic, said problem deems to be caused by the deterioration or the affection of the components which consist in the thermally sensitive recording layer.

Further, the important point of the neutral paper used in this invention is that it contains a wet strength reinforcing agent. When filler is contained, since said filler absorbs the wet strength reinforcing agent, the desired wet strength can not be obtained. Therefore, not withstanding an acidic paper or a neutral paper, in a case of paper manufacturing process using a wet strength reinforcing agent, it is ordinary to manufacture a paper without filler or controlling the content of filler as a solid less than 4 wt. % of pulp. This is also same in a case of the diazo base paper. On the contrary, in the case of the neutral paper used in this invention, it is effective to contain a filler as a solid by 5–20 wt. % to the of pulp. By containing a filler by said limit, the excellent color developing sensitivity can be obtained keeping the sufficient paper strength as face stock the thermally sensitive recording type adhesive label, further the problem of becoming transparent when wetted by water can be avoided. More desirable limit of the content of a filler is 7–15%.

In the present invention, when a neutral paper is used as the substrate, the deterioration of adhering strength of an adhesive layer can be avoided. The reason why is still unclear, however, it is surmised that the deterioration of adhering strength is caused by the reaction between adhesive agent and calcium ions contained in the neutral paper. And, in a case of this invention, it is surmised that the presence of the wet strength reinforcing agent gives some effects, and above mentioned reaction can be effectively controlled.

DETAILED DESCRIPTION OF THE INVENTION

At the manufacturing of the neutral paper used in this invention, a kind of wet strength reinforcing agent to be used is not restricted, for example, urea resin, melamine resin, urea-formaldehyde resin, melamine-formaldehyde resin, polyamide-polyurea-formaldehyde resin, polyamide resin, polyamide-epichlorohydrin resin, polyamide-polyamine-epichlorohydrin resin, epoxidized polyamide resin, polyethylene-imine resin, aldehyde starch or ketone aldehyde resin can be used. More than two kinds of these compounds can be used in combination as occasion demands. Especially, among these compounds, polyamide-epichlorohydrin resin and polyamide-polyamine-epichlorohydrin resin are desirably used.

When the content of wet strength reinforcing agent is too small, the sufficient water resistance cannot be obtained, and when the content of wet strength reinforcing agent is too much, the problems such as pitch trouble or press stain are frequently caused. Therefore, the desirable containing amount of the wet strength reinforcing agent as a solid is 0.3–1.0 wt. % of pulp. In the present invention, by containing the wet strength reinforcing agent by said limit, the desired water resistance can effectively be obtained without hurting the productivity. More desirable limit of the content of wet strength reinforcing agent is 0.3–0.5 wt. %.

Further, as a filler, any kinds of fillers such as clay, talk, calcium carbonate or titanium dioxide can be used, and among these mentioned fillers, calcium carbonate is desirably used.

As the pulp used for the manufacturing of a base paper, NBKP, LBKP, NBSP, LBSP, CGP, GP, recycled paper pulp or various kinds of non-wooden pulps can be mentioned.

In the neutral paper used in this invention, alkyl ketene dimmer, alkenyl succinic acid anhydride, petroleum resins, styrene resins and higher alcohols can be used as the neutral sizing agent, and among these, alkyl ketene dimmer is desirably used. The amount of the neutral sizing agent to be added is as a solid 0.05–1.5 wt. % of pulp. As the fixing agent for these neutral sizing agent, aluminum sulfate, polyamide, acrylamide or cationic starch can be used. As a size press solution, starch, PVA, alkyl ketene dimmer, alkenyl succinic acid anhydride, petroleum resins or styrene resins can be used, and these compounds can be used alone or can be used in combination. Further, a water resistance agent such as glyoxal can be used as occasion demands.

As a material for an adhesive layer formed between the reverse side of the substrate and the release paper of this invention, the conventional materials which are used ordinary in the label preparation process can be used.

In the present invention, the kind of basic colorless dye to be used in the thermally sensitive recording layer is not restricted, a leuco dye such as triphenyl methane type, fluoran type, azaphtalide type or fluorene type can be desirably used. The concrete examples of these leuco dyes are mentioned below. These basic leuco dyes can be used alone or can be used in combination.

<Triphenylmethane Type Leuco Dyes>

3,3-bis(p-dimethylaminophenyl)-6-dimethylaminophthalide [another name is Crystal Violet Lactone]

3,3-bis(p-dimethylaminophenyl)phthalide [another name is Malachite Green Lactone]

<Fluoran Type Leuco Dyes>

3-diethylamino-6-methylfluoran
3-diethylamino-6-methyl-7-anilinofluoran
3-diethylamino-6-methyl-7-(o,p-dimethylanilino)fluoran
3-diethylamino-6-methyl-7-chlorofluoran
3-diethylamino-6-methyl-7-(m-trifluoromethylanilino)fluoran
3-diethylamino-6-methyl-7-(o-chloroanilino)fluoran
3-diethylamino-6-methyl-7-(p-chloroanilino)fluoran
3-diethylamino-6-methyl-7-(o-fluoroanilino)fluoran
3-diethylamino-6-methyl-7-(m-methylanilino)fluoran
3-diethylamino-6-methyl-7-n-octylanilinofluoran
3-diethylamino-6-methyl-7-n-octylaminofluoran
3-diethylamino-6-methyl-7-benzylanilinofluoran
3-diethylamino-6-methyl-7-dibenzylanilinofluoran
3-diethylamino-6-chloro-7-methylfluoran
3-diethylamino-6-chloro-7-anilinofluoran
3-diethylamino-6-chloro-7-p-methylanilinofluoran
3-diethylamino-6-ethoxyethyl-7-anilinofluoran
3-diethylamino-7-methylfluoran
3-diethylamino-7-chlorofluoran
3-diethylamino-7-(m-trifluoromethylanilino)fluoran
3-diethylamino-7-(o-chloroanilino)fluoran
3-diethylamino-7-(p-chloroanilino)fluoran
3-diethylamino-7-(o-fluoroanilino)fluoran
3-diethylamino-benzo[a]fluoran
3-diethylamino-benzo[c]fluoran
3-dibutylamino-6-methyl-fluoran
3-dibutylamino-6-methyl-7-anilinofluoran
3-dibutylamino-6-methyl-7-(o,p-dimethylanilino)fluoran
3-dibutylamino-6-methyl-7-(o-chloroanilino)fluoran
3-dibutylamino-6-methyl-7-(p-chloroanilino)fluoran
3-dibutylamino-6-methyl-7-(o-fluoroanilino)fluoran
3-dibutylamino-6-methyl-7-(m-trifluoromethylanilino)fluoran
3-dibutylamino-6-methyl-chlorofluoran
3-dibutylamino-6-ethoxyethyl-7-anilinofluoran
3-dibutylamino-6-chloro-7-anilinofluoran
3-dibutylamino-6-methyl-7-p-methylanilinofluoran
3-dibutylamino-7-(o-chloroanilino)fluoran
3-dibutylamino-7-(o-fluoroanilino)fluoran
3-di-n-pentylamino-6-methyl-7-anilinofluoran
3-di-n-pentylamino-6-methyl-7-(p-chloroanilino)fluoran
3-di-n-pentylamino-6-chloro-7-anilinofluoran
3-di-n-pentylamino-7-(p-chloroanilino)fluoran
3-di-n-pentylamino-7-(m-trifluoromethylaniliono)fluoran
3-pyrrolidino-6-methyl-7-anilinofluoran
3-piperidino-6-methyl-7-anilinofluoran
3-(N-methyl-N-propylamino)-6-methyl-7-anilinofluoran
3-(N-methyl-N-cyclohexylamino)-6-methyl-7-anilinofluoran
3-(N-ethyl-N-cyclohexylamino)-6-methyl-7-anilinofluoran
3-(N-ethyl-N-xylamino)-6-methyl-7-(p-chloroanilino)fluoran
3-(N-ethyl-N-p-toluidino)-6-methyl-7-anilinofluoran
3-(N-ethyl-N-isoamylamino)-6-methyl-7-anilinofluoran
3-(N-ethyl-N-isoamylamino)-6-chloro-7-anilinofluoran
3-(N-ethyl-N-tetrahydrofurfurylamino)-6-methyl-7-anilinofluoran
3-(N-ethyl-N-isobutylamino)-6-methyl-7-anilinofluoran
3-cyclohexylamino-6-chlorofluoran
2-(4-oxahexyl)-3-dimethylamino-6-methyl-7-anilinofluoran
2-(4-oxahexyl)-3-diethylamino-6-methyl-7-anilinofluoran
2-(4-oxahexyl)-3-dipropylamino-6-methyl-7-anilinofluoran
2-methyl-6-p-(p-dimethylaminophenyl)aminoanilinofluoran
2-methoxy-6-p-(p-dimethylaminophenyl)aminoanilinofluoran
2-chloro-3-methyl-6-p-(p-phenylaminophenyl)aminoanilinofluoran
2-chloro-6-p-(p-dimethylaminophenyl)aminoanilinofluoran
2-nitro-6-p-(p-diethylaminophenyl)aminoanilinofluoran
2-amino-6-p-(p-diethylaminophenyl)aminoanilinofluoran
2-diethylamino-6-p-(p-diethylaminophenyl)aminoanilinofluoran
2-benzyl-6-p-(p-phenylaminophenyl)aminoanilinofluoran
2-hydroxy-6-p-(p-phenylaminophenyl)aminoanilinofluoran
3-methyl-6-p-(p-dimethylaminophenyl)aminoanilinofluoran
3-diethylamino-6-p-(p-diethylaminophenyl)aminoanilinofluoran
3-diethylamino-6-p-(p-dibutylaminophenyl)aminoanilinofluoran
2,4-dimethyl-6-[(4-dimethylamino)anilino]-fluoran <Fluorene Type Leuco Dyes>

3,6,6'-tris(dimethylamino)spiro[fluorene-9,3'-phthalide]
3,6,6'-tris(diethylamino)spiro[fluorene-9,3'-phthalide]

<Divinyl Type Leuco Dyes>

3,3-bis-[2-(p-dimethylaminophenyl)-2-(p-methoxyphenyl)ethenyl]-4,5,6,7-tetra bromophthalide
3,3-bis-[2-(p-dimethylaminophenyl)-2-(p-methoxyphenyl)ethenyl]-4,5,6,7-tetra chlorophthalide
3,3-bis-[1,1-bis(4-pyrrolidinophenyl)ethylene-2-yl]-4,5,6,7-tetrabromophthalide
3,3-bis-[1-(4-methoxyphenyl)-1-(4-pyrrolidinophenyl)ethylene-2-yl]-4,5,6,7-tetrachlorophthalide <Others>

3-(4-diethylamino-2-ethoxyphenyl)-3-(1-ethyl-2-methylindol-3-yl)-4-azaphthalide
3-(4-diethylamino-2-ethoxyphenyl)-3-(1-octyl-2-methylindol-3-yl)-4-azaphthalide
3-(4-cyclohexylethylamino-2-methoxyphenyl)-3-(1-ethyl-2-methylindol-3-yl)-4-azaphthalide
3,3-bis(1-ethyl-2-methylindol-3-yl)phthalide 3,6-bis(diethylamino)fluoran-γ-(3'-nitro)anilinolactam
3,6-bis(diethylamino)fluoran-γ-(4'-nitro)anilinolactam
1,1-bis-[2',2',2",2"-tetrakis-(p-dimethylaminophenyl)-ethenyl]-2,2-dinitrilethane
1,1-bis-[2',2',2",2"-tetrakis-(p-dimethylaminophenyl)-ethenyl]-2-β-naphthoyl ethane
1,1-bis-[2',2',2",2"-tetrakis-(p-dimethylaminophenyl)-ethenyl]-2,2-diacetylethane
bis-[2,2,2',2'-tetrakis-(p-dimethylaminophenyl)-ethenyl]-methylmalonicacid dimethylester.

As an organic color developer used in a thermally sensitive recording layer of this invention, the well-known color developer can be mentioned as follows, however, not intended to be limited to them.

Inorganic acidic substance such as activated clay, attapulgite, colloidal silica or aluminum silicate,
4,4'-isopropylidenediphenol
1,1-bis(4-hydroxyphenyl)cyclohexane
2,2-bis(4-hydroxyphenyl)-4-methylpentane
4,4'-dihydroxydiphenylsulfide
hydroquinonemonobenzylether
4-hydroxybenzoicbenzyl
4,4'-dihydroxydiphenylsulfone
2,4'-dihydroxydiphenylsulfone
4-hydroxy-4'-isopropoxydiphenylsulfone
4-hydroxy-4'-n-propoxydiphenylsulfone
bis(3-allyl-4-hydroxyphenyl)sulfone
4-hydroxy-4'-methyldiphenylsulfone
4-hydroxyphenyl-4'-benzyloxyphenylsulfone
3,4-dihydroxyphenyl-4'-methylphenylsulfone
Derivative of aminobenzenesulfone Amide Described in Japanese Patent Laid Open Publication 8-59603,
bis(4-hydroxyphenylthioethoxy)methane
1,5-di(4-hydroxyphenylthio)-3-oxapentane
bis(p-hydroxyphenyl)butyl acetate
bis(p-hydroxyphenyl)methyl acetate
1,1-bis(4-hydroxyphenyl)-1-phenylethane
1,4-bis[α-methyl-α-(4-hydroxyphenyl)ethyl]benzene
1,3-bis[α-methyl-α-(4-hydroxyphenyl)ethyl]benzene
di(4-hydroxy-3-methylphenyl)sulfido
2,2'-thio-bis(3-tert-octylphenol)
2,2'-thio-bis(4-tert-octylphenol)
Phenolic Compound such as Diphenylsulfone Bridged Type Compound Described in WO97/16420,
thio urea compound such as N,N'-di-m-chlorophenylthiourea,
p-chloro benzoic acid,
gallic acid stearyl
aromatic carboxylic acid such as
bis[4-(n-octyloxycarbonylamino)zinc salicylate]2 hydrate,
4-[2-(p-methoxyphenoxy)ethyloxy]salicylic acid,
4-[3-(p-tolylsulfonyl)propyloxy]salicylic acid or
5-[p-(2-p-methoxyphenoxyethoxy)cumyl]salicylic acid
and metallic salts of these aromatic carboxylic acid with zinc, magnesium, aluminum, calcium, titanium, manganese, tin or nickel, further, antipyrine complex of zinc thiocyanate and complex zinc salt of terephtalic aldehyde acid and other aromatic carboxylic acid can be mentioned. These organic color developers can be used alone or can be used in combination.

Further, a metal chelate type color developing component such as high fatty acid metal complex salt described in Japanese Patent Laid Open Publication 10-258577 or multivalent hydroxy aromatic compound can be used.

In the present invention, for the purpose to improve the thermally recording color developing sensitivity, a sensitizer can be contained in the thermally sensitive recording layer. As the sensitizers, any kinds of compounds that are conventionally used in a thermally sensitive recording medium can be used. For example, fatty acid amide such as stearic acid amide or palmitic acid amide, ethylenebisamide, montanewax, polyethylenewax, dibenzylterephthalate, p-benzyloxy benzyl benzoate, di-p-tolylcarbonate, p-benzylbiphenyl, phenyl α-naphthylcarbonate, 1,4-diethoxy naphthalene, 1-hydroxy-2-phenylnaphthoate, 1,2-di-(3-methylphenoxy)ethane, oxalic acid di(p-methylbenzyl), β-benzyloxy naphthalene, 4-biphenyl-p-tolylether, o-xylene-bis-(phenylether), 4-(m-methyl phenoxymethyl)biphenyl, p-toluenesulfoneamide and o-toluenesulfoneamide can be added. These sensitizers can be used alone or can be used in combination.

In the present invention, mainly for the purpose to improve the preservative ability of the color developed recorded image, an image stabilizer can be contained in the thermally sensitive recording layer. As the image stabilizer, for example, at least one compound selected from the group composed of phenol type compound such as
1,1,3-tris(2-methyl-4-hydroxy-5-cyclohexylphenyl)butane,
1,1,3-tris(2-methyl-4-hydroxy-5-tert-butylphenyl)butane,
1,1-bis(2-methyl-4-hydroxy-5-tert-butylphenyl)butane,
4,4'-[1,4-phenylenebis(1-methylethylidene)]bisphenol,
4,4'-[1,3-phenylenebis(1-methylidene)]bisphenol,
4,4'-butylidene(6-t-butyl-3-methylphenol) or
2,2'-di-t-butyl-5,5-dimethyl-4,4-sulfonyldiphenol,
epoxy compound such as
4-benzyloxyphenyl-4'-(2-metyl-2,3-epoxypropyloxy) phenylsulfone,
4-(2-metyl-1,2-epoxyethyl)diphenylsulfone or
4-(2-ethyl-1,2-epoxyethyl)diphenylsulfone and isocyanuric acid compound such as
1,3,5-tris(2,6-dimethylbenzyl-3-hydroxy-4-tert-butyl) isocyanuric acid can be used.
These image stabilizers can be used alone or can be used together with.

For the preparation of the thermally sensitive recording medium, conventional well-known binders can be used to bind a basic colorless dye and an organic color developer and other materials on a substrate. As the concrete example of the binder, full saponified polyvinyl alcohol, partial saponified polyvinyl alcohol, denatured polyvinyl alcohol by carboxyl, denatured polyvinyl alcohol by amide, denatured polyvinyl alcohol by sulfonic acid, denatured polyvinyl alcohol by butyral or other modified polyvinyl alcohol of 200–1900 polymerization degree, derivatives of cellulose such as hydroxyethyl cellulose, methyl cellulose, carboxymethyl cellulose, ethyl cellulose and acetyl cellulose, copolymer of styrene-maleic acid anhydride, copolymer of styrene-butadiene, polyvinyl chloride, polyvinyl acetate, polyacrylamide, polyacrylic acid ester, polyvinylbutyral, polystyrene or copolymers of them, polyamide resin, silicone resin, petroleum resin, terpene resin, ketone resin and coumarone resin can be mentioned. These macromolecule compounds can be applied by being dissolved into solvents such as water, alcohol, ketone, ester or hydrocarbon or by being dispersed in water or other medium under an emulsion state or a paste state and these forms of application can be used in combination according to the quality requirement.

As a filler which can be used in this invention, an inorganic filler such as silica, calcium carbonate, clay, kaolin, calcined kaolin, diatomaceous earth, synthetic aluminum silicate, talc, zinc oxide, titanium di-oxide, aluminum hydroxide, zinc hydroxide, barium sulfate, magnesium carbonate, surface treated calcium carbonate or silica, and an organic filler such as urea-formalin resin, styrenemethacrylic acid copolymer resin, polystyrene resin and vinylidene chloride can be mentioned.

Further, a parting agent such as metallic salts of fatty acid, a lubricant such as waxes, a water resistance agent such as glyoxal, a dispersing agent, a defoamer, and a fluorescent dye and an UV absorbent which are well-known materials used in a thermally sensitive recording medium can be preferably used.

The preparing method of the coating color for a thermally sensitive recording layer of this invention is not restricted, however, the amount of basic colorless dye, organic color developer and amount of other components are decided according to the required properties and the recording aptitude. The desirable amount of organic color developer is 1–8 parts, desirable amount of filler is 1–20 parts to 1 part of basic colorless dye, and desirable amount of binder is 5–25% of the total weight of solid. Said basic colorless dye, organic color developer and other additives which are added as occasion demands, are ground to the fine particles smaller than several microns diameter by means of a grinder such as a ball mill, an attriter or a sand grinder, or by means of an adequate emulsifying apparatus, then binder and other additives are added when the need arises, and the coating color is prepared.

The method to form the thermally sensitive recording layer is not restricted, and the coating color of above mentioned recipe is coated over the substrate by means of blade coater, air knife coater, bar coater or reverse roll coater and dried up, thus the aimed thermally sensitive recording medium can be obtained.

In the thermally sensitive recording medium of this invention, as occasion demands, for the purpose to improve the preservability, a protective layer containing a binder and a filler can be formed on thermally sensitive recording layer, and an undercoating layer containing a binder and a filler can be formed between substrate and a thermally sensitive recording layer, further a back coating layer can be formed on the reverse side of the substrate.

At the preparation of an undercoating layer, as a binder, a filler and other kinds of additives, the materials which are indicated as the components of the thermally sensitive recording layer can be used according to the required quality. Well-known hollow particles used for an undercoating layer of conventional thermally sensitive recording medium such as fine hollow particles with hull described in Japanese Patent Publication 3-54074 or cup shape hollow polymer particles described in Japanese Patent Laid Open Publication 10-217608 or a calcined kaolin, have an excellent adiabatic effect and desirable for the filler used for an undercoating layer. The preparing method of a coating for undercoating layer is not restricted. In general, said coating color is prepared by mixing a binder and a filler using water as a dispersing medium, and a deformer is added as occasion demands. The method to form an undercoating layer is not restricted, and for example, a coating for the undercoating layer is coated on the substrate by various coating methods same as to the forming method of above mentioned thermally sensitive recording layer, and dried up and the undercoating layer is formed.

In a case to form a protecting layer, as a binder, a filler and other kinds of additives, the materials which are indicated as the components of the thermally sensitive recording layer can be used according to the required quality. In this case, it is desirable to add a bridging agent so as to provide water resistance to the protecting layer. The preparing method of a coating for the protecting layer is not restricted. In general, besides an aqueous binder, a filler and a lubricant are poured into water, which is a dispersing medium, when the needs arises. The method to form a protecting layer is not restricted, and for example, a coating for the protecting layer is coated on the thermally sensitive recording layer by various coating methods same as to the forming method of above mentioned thermally sensitive recording layer, and dried up and thus the protecting layer is formed. As the resin used in a protecting layer, a hydrophobic resin, an ultraviolet ray hardening resin or an electron-beam hardening resin can be used.

EXAMPLE

The present invention will be illustrated more concretely by the Examples, however, not intended to be limited to them. In the Examples and Comparative Examples, a term of "parts" indicates weight parts.

Example 1

(Blending Ratio of a Base Paper)

| | |
|---|---|
| LBKP (freeness: 300 ml, csf) | 80.0 parts |
| NBKP (freeness: 300 ml, csf) | 20.0 parts |
| Light calcium carbonate (product of Shiraishi Industries Co., Ltd., PCX-850) | 10.0 parts |
| alkyl ketene dimmer | 1.0 parts |
| aluminum sulfate | 1.0 parts |
| 30% aqueous solution of polyamide-epichlorohydrin (product of Nihon PMC Co., Ltd., WS535) | 1.5 parts |

Using above mentioned blended pulp slurry, a base paper of 45 g/m$^2$ is manufactured by a Fourdrinier paper machine by 350 m/min manufacturing speed.

(Blending of Size Press Liquid)

The obtained base paper is treated by a sizing press machine by following blending ratio so as the mass of deposit to be 1.2 g/m$^2$.

| | |
|---|---|
| oxidized starch | 4.0 parts |
| alkyl ketene dimmer | 0.5 parts |
| water | 95.5 parts |
| (Forming of the undercoating layer) | |
| 10% polyvinyl alcohol aqueous solution | 150 parts |
| calcined kaolin (40% dispersion) | 250 parts |

Above mentioned materials are mixed by above-mentioned ratio and stirred, and the coating color for undercoating layer is obtained. The obtained coating color is coated on one side of said base paper so as the coating amount to be 5.0 g/m$^2$ and dried, and an undercoating layer is formed.

(Forming of the Thermally Sensitive Recording Layer)

Each solution of following recipe are separately ground to average particle diameter of 1 $\mu$m by a sand grinder.

| | |
|---|---|
| A solution (dispersion of color developer) | |
| 2,4'-dihydroxydiphenylsulfone | 6.0 parts |
| 10% polyvinyl alcohol aqueous solution | 18.8 parts |
| water | 11.2 parts |
| B solution (dispersion of basic leuco dye) | |
| 3-di-butylamino-6-methyl-7-anilinofluoran (ODB-2) | 2.0 parts |
| 10% polyvinyl alcohol aqueous solution | 4.6 parts |
| water | 2.6 parts |

-continued

| C solution (dispersion of sensitizer) | |
|---|---|
| parabenzylbiphenyl | 4.0 parts |
| 10% polyvinyl alcohol aqueous solution | 5.0 parts |
| water | 3.0 parts |

Then obtained dispersions are mixed by following ratio and stirred, and the coating color for thermally sensitive recording layer is obtained.

| | |
|---|---|
| A solution | 36.0 parts |
| B solution | 9.2 parts |
| C solution | 12.0 parts |
| Kaolin clay (50% dispersion) | 12.0 parts |

The obtained coating color is coated on the undercoating layer so as the coating amount to be 6.0 g/m$^2$ and dried, and a thermally sensitive recording layer is obtained.

(Forming of a Protecting Layer)

Following dispersions are mixed together by mentioned ratio then stirred and the coating color for protecting layer is prepared.

| | |
|---|---|
| 10% polyvinyl alcohol aqueous solution | 60.0 parts |
| aluminum hydroxide (50% dispersion) | 30.0 parts |
| zinc stearate (50% dispersion) | 10.0 parts |
| water | 50.0 parts |

The obtained coating color is coated on the thermally sensitive recording layer so as the coating amount to be 4.0 g/m$^2$ and dried, and the protecting layers are obtained.

The obtained sheet is processed by a super calendar so as the Bekk smoothness to be 200–600 seconds, and the thermally sensitive recording medium is obtained. Then, an adhesive layer is formed on the reverse side, a release paper is adhered, and thus the thermally sensitive recording type adhesive label is obtained.

Comparative Example 1

By the same processes to the Example 1, except changing the blending ratio of paper and size pressing solution as follows, the Comparative Example 1 is obtained.

(Blending Ratio of a Base Paper: Diazo Base Paper)

| | |
|---|---|
| LBKP (freeness: 300 ml, csf) | 80.0 parts |
| NBKP (freeness: 300 ml, csf) | 20.0 parts |
| talk | 4.0 parts |
| rosin size | 1.5 parts |
| aluminum sulfate | 3.0 parts |
| 30% aqueous solution of polyamide-epichlorohydrin (product of Nihon PMC Co., Ltd., WS535) | 1.5 parts |

(Blending of Size Press Liquid)

| | |
|---|---|
| oxidized starch | 4.0 parts |
| water | 96.0 parts |

Comparative Example 2

By the same processes to the Example 1, except changing the blending ratio of a base paper, the Comparative Example 2 is obtained.

(Blending Ratio of Base Paper: Neutral Paper)

| | |
|---|---|
| LBKP (freeness: 300 ml, csf) | 80.0 parts |
| NBKP (freeness: 300 ml, csf) | 20.0 parts |
| light calcium carbonate (product of Shiraishi Industries Co., Ltd., PCX-850) | 10.0 parts |
| alkyl ketene dimmer | 1.0 parts |
| aluminum sulfate | 1.0 parts |

Comparative Example 3

By the same processes to the Example 1, except changing the blending ratio of a base paper, the Comparative Example 3 is obtained.

(Blending Ratio of a Base Paper: Wet Strength Reinforced Paper)

| | |
|---|---|
| LBKP (freeness: 300 ml, csf) | 80.0 parts |
| NBKP (freeness: 300 ml, csf) | 20.0 parts |
| light calcium carbonate (product of Shiraishi Industries Co., Ltd., PCX-850) | 4.0 parts |
| alkyl ketene dimmer | 1.0 parts |
| aluminum sulfate | 1.0 parts |
| 30% aqueous solution of polyamide-epichlorohydrin (product of Nihon PMC Co., Ltd., WS535) | 1.5 parts |

Following quality evaluation tests are carried out on thermally sensitive recording type adhesive labels obtained in above-mentioned Example and Comparative Examples. Obtained results are summarized in Table 1. In Table 1 (1) indicates 18 mJ/mm$^2$, and (2) indicates 26 mJ/mm$^2$.

[Image Density]

The printing tests on prepared thermally sensitive recording type adhesive labels are carried out using UBI printer type 201 (product of UBI Co.,) by 18 mJ/mm$^2$ and 26 mJ/mm$^2$ impressive energy. Image density after printing are measured by means of a Macbeth densitometer (RD914, umber filter used).

[Degree of brightness of Background Color]

Degree of brightness of not color developed portion of specimen is measured by Hunter Brightness tester (product of Toyo Seiki Seisakusho, blue filter).

[Heat Resistance Test]

Specimen of printed image using UBI printer type 201 (product of UBI Co.,) by 26 mJ/mm$^2$ impressive energy and a specimen not color developed are placed in the atmosphere of 80° C., for 24 hrs, and the image density of developed color is measured by Macbeth densitometer, and degree of brightness of not color developed portion of specimen is measured by Hunter Brightness tester (product of Toyo Seiki Seisakusho, blue filter).

[Water Resistance of Adhesion]

After the specimen is dipped in water for 2 minutes, the adherence strength between substrate and adhesive layer is evaluated according to the following standard.

○ . . . adhesive layer is not released by rubbing by finger x . . . adhesive layer is easily released

TABLE 1

| | color | | | heat resistance | | |
|---|---|---|---|---|---|---|
| | developing density | | degree of | color developed | ground blank | water resistance |
| | (1) | (2) | brightness | part | part | of adhesion |
| Example 1 | 0.86 | 1.23 | 86% | 1.20 | 78% | ○ |
| Comp. Ex. 1 | 0.75 | 1.12 | 79% | 1.15 | 55% | ○ |
| Comp. Ex. 2 | 0.88 | 1.29 | 85% | 1.19 | 75% | x |
| Comp. Ex. 3 | 0.70 | 1.09 | 83% | 1.05 | 72% | ○ |

It is clearly understood from the results mentioned above, that Example 1 that satisfy the important points of this invention expresses excellent results on following properties, that is, color developing sensitivity, degree of brightness of background color, heat resistance and water resistance of adhesion between substrate and adhesive layer, and indicates well balanced quality. On the contrary, the Comparative Example 1 that uses an acidic diazo base paper is inferior in color developing sensitivity, degree of brightness and heat resistance of background color. Further, by the Comparative Example 2 that uses the neutral paper to which a wet strength reinforcing agent is not added a sufficient heat resistance of ground color can not be obtained, and said Comparative Example 2 is also inferior in water resistance of adhesion. Furthermore, in the case of Comparative Example 3 that uses the neutral paper to which a wet strength reinforcing agent is added but the amount of filler content is smaller that the limit regulated in this invention, color developing sensitivity and heat resistance of ground color are not sufficient.

Effect of the Invention

According to the present invention, it is possible to provide the thermally sensitive recording type adhesive label which is especially superior in printing density and indicates good degree of brightness and background color preservability, still more, the adhesive layer of which does not release even if water is stuck or it is exposed in high humidity condition. Further, since the thermally sensitive recording type adhesive label of this invention does not become transparent by sticking of water, the highly precise readout precision without errors can be expected at the use for the barcode readout. Thus, the thermally sensitive recording type adhesive label of this invention can be actually used with an excellent evaluation and can be said as a very useful commodity.

What is claimed is:

1. A thermally sensitive recording adhesive label possessing a thermally sensitive recording layer on a substrate, and an adhesive layer and a release paper on the reverse side of the substrate, wherein said substrate is a neutral paper containing a wet strength reinforcing agent wherein the wet strength reinforcing agent is present in an amount of from 0.3 to 1.0 wt %, based on the total weight of pulp, and further containing 5 to 20 wt % of filler to the total weight of pulp.

2. The thermally sensitive recording adhesive label according to claim 1, wherein the paper comprises a neutral sizing agent.

3. The thermally sensitive recording adhesive label according to claim 2, wherein the neutral sizing agent is chosen form alkyl ketene dimer, alkenyl succinic acid anhydride, petroleum resin, styrene resin and higher alcohol.

4. The thermally sensitive recording adhesive label according to claim 3, wherein the neutral sizing agent is provided in amount of 0.05 wt %, based on the total weight of pulp.

5. The thermally sensitive recording adhesive label according to claim 1, wherein the wet strength reinforcing agent is present in an amount of from 0.3 to 0.5 wt %, based on the total weight of pulp.

6. The thermally sensitive recording adhesive label according to claim 5, wherein the wet strength reinforcing agent is chosen from urea resin, melamine resin, urea-formaldehyde resin, melamine-formaldehyde resin, polyamide-polyurea-formaldehyde resin, polyamide resin, polyamide-epichlorohydrin resin, polyamide-polyamine-epichlorohydrin resin, epoxidized polyamide resin, polyethylene-imine resin, aldehyde starch or ketone aldehyde resin.

7. The thermally sensitive recording adhesive label according to claim 6, wherein the filler is present in an amount of from 7 to 15 wt %, based on the total weight of pulp.

8. The thermally sensitive recording adhesive label according to claim 2, wherein the filler is calcium carbonate.

* * * * *